United States Patent [19]

Spaller

[11] Patent Number: 4,519,281

[45] Date of Patent: May 28, 1985

[54] PACKAGE WIND CUTTER

[75] Inventor: Albert E. Spaller, Johnson City, Tenn.

[73] Assignee: Eastman Kodak Company, Rochester, N.Y.

[21] Appl. No.: 472,509

[22] Filed: Mar. 7, 1983

[51] Int. Cl.[3] ..... D01G 1/04

[52] U.S. Cl. ..... 83/37; 83/346; 83/913

[58] Field of Search ..... 83/37, 347, 346, 403, 83/913; 19/0.6, 0.62

[56] References Cited

U.S. PATENT DOCUMENTS

| | | | |
|---|---|---|---|
| 3,485,120 | 12/1969 | Keith | 83/913 X |
| 3,744,361 | 7/1973 | Van Doorn et al. | 83/913 X |
| 3,861,257 | 1/1975 | Laird et al. | 83/913 X |
| 3,915,042 | 10/1975 | Laird | 83/913 X |
| 4,014,231 | 3/1977 | Hutzezon | 83/913 X |
| 4,237,758 | 12/1980 | Lindner et al. | 83/913 X |

*Primary Examiner*—Frank T. Yost

*Attorney, Agent, or Firm*—Malcolm G. Dunn; Daniel B. Reece, III

[57] ABSTRACT

Apparatus and method for cutting a strand into predetermined lengths, wherein a cutting head having a plurality of cutting blades forming a cutting zone rotates around one axis and a strand winding device rotates around an axis intercepting the other axis and at a significantly higher rate of speed than the cutting head so that the strand is received and stored in cutting position in the cutting zone in the form of multiple crossing windings prior to cutting, and pressure is applied against the windings and toward the cutting blades to cut the strand into such predetermined lengths.

11 Claims, 4 Drawing Figures

PACKAGE WIND CUTTER

DESCRIPTION

The present invention is directed to an apparatus and a method for cutting one or more strands into predetermined lengths, such as an apparatus and method for cutting textile and industrial continuous length filaments into staple fibers.

There is a need in industry, such as in the textile industry, for a staple fiber cutter capable of receiving and cutting filaments and filament yarns issuing directly from spinning cabinets at speeds at which the spinning cabinets may be operated. The staple fiber cutter of this invention, when used for a number of different products, will eliminate the necessity and the equipment required for first collecting the cabinet yarn ends from a number of different spinning cabinet lines, puddling the cabinet ends into a series of containers, later withdrawing and joining the puddled cabinet ends from the containers to form filament tows having greater widths and thicknesses, passing such filament tows through different processes, and only afterward cutting the filament tows into staple fiber lengths.

U.S. Pat. No. 3,485,120 discloses a staple fiber cutter which has a circular cutter reel having cutting blades spaced around the reel and a pressure roller spaced from the cutting edges of the cutting blades. As the cutter reel makes one revolution relative to the pressure roller, a single layer of filament tow, such as a tow of one million denier, is wound around the cutter reel, with each subsequent revolution forming a layer of tow superposed with respect to the preceding layer. The pressure roller applies pressure against the superposed layers of tow and toward the cutting edges to cause the layer in contact with the cutting edges to be forced past the cutting edges in a cutting action. In this manner each layer moves into contact with the cutting edges and then is cut into staple fiber lengths. The amount of material cut for each cutter reel revolution is approximately equal to the amount of material fed to and wrapped around the cutter reel during that same cutter reel revolution.

This staple fiber cutter is typically operated for long periods of time at speeds of around 150 rpm, with a typical higher speed being around 200 rpm. Since the cutter reel, which may be about one meter in circumference, and its cutting blades and supporting member for the cutting blades represent a certain amount of weight, there would be mechanical limitations in attempting to operate it at the spinning speeds typically employed by spinning cabinets. Present-day spinning speeds for polyester yarns, for instance, may range from about 1,000 to about 4,000 meters per minute. If the patented cutter reel were attempted to be operated for long periods of time at 4,000 rpm, there would be bearing problems and the structural integrity of the cutter reel would be endangered due to the centrifugal forces generated. In addition, the centrifugal forces involved at speeds in excess of 1,000 rpm would make it difficult to keep the tow against the blades and to allow discharge of the staple fibers from the center of the cutter reel. The staple fibers would not discharge uniformly from the center of the cutter reel and would thus tend to cling in clumps to one side or another of the cutter reel and throw it out of balance. This latter action would cause damage to the bearings.

Vibration problems can become quite significant at such higher speeds due to the effect caused by the pressure roller "bumping" from one blade to the next through the layers of tow as the cutter reel revolves under the pressure roller. Severe "bumping" can cause blade breakage, and blade breakage can also throw the cutter reel out of balance at those speeds with damage also being caused to the bearings.

In the staple fiber cutter of the present invention, a separate winding device delivers a large number of windings to the cutting head while the cutting head makes a single revolution relative to two pressure rollers spaced from the cutting edges of the cutting head and spaced opposite each other. For example, the winding device may deliver enough strand material to the cutting head to form two hundred windings for each revolution of the cutting head. The windings are positioned side by side across the cutting blades and are wound in such manner that each winding will cross a previous winding one or more times. The multiple crossing windings fill the space between the cutting edges of the cutting blades and the pressure rollers, and the cutting head will cut in a single revolution as much strand material as is delivered to the cutting head during such single revolution.

The staple fiber cutter of the present invention may typically handle a smaller denier tow issuing from spinning cabinets such as a tow of 50,000 denier. Assuming that the circumference of the cutting head is about one meter and the spinning cabinets are spinning at the rate of about 4,000 meters per minute, if the winding device revolves at 3,980 rpm while the cutting head revolves at 20 rpm, then the 50,000 denier tow will be taken up by the cutting head at the rate of about 4,000 meters per minute with the cutting head cutting 4,000 meters of material, or about 22.2 kilograms of tow material into staple fiber in one minute (9,000 meters of one denier tow weigh one gram).

Since the winding device of the staple fiber cutter of the present invention can revolve at very high rates of speed, the staple fiber cutter can readily take up and store a significant length of strand in preparation for cutting from spinning cabinets at the speeds at which such spinning cabinets may be operated. This operation is not possible with the heretofore known staple fiber cutter.

The staple fiber cutter of the present invention also does not have the mechanical limitations that previous staple fiber cutters have because the cutting head revolves at a much lower speed and the winding device has a significantly lower weight which allows it to operate safely at significantly higher speeds.

DISCLOSURE OF THE INVENTION

In accordance with the present invention, an apparatus is disclosed for cutting a strand into predetermined lengths, the apparatus being characterized by (a) a cutting head mounted for rotation around its axis at a predetermined speed, the cutting head having a plurality of cutting blades mounted and arranged to form a cutting zone of predetermined width and predetermined peripheral length to receive and store in cutting position multiple windings of strand for subsequent cutting into such predetermine lengths; (b) strand winding device mounted to rotate around an axis intercepting the axis of the cutting head in such manner that the strand winding device traverses back and forth along a predetermined width of the cutting zone during each revolution of the strand winding device, the strand winding device rotating at a significantly faster speed than the cutting head and the relative rotations of the strand winding device and the cutting head cooperating to position multiple crossing windings of the strand in the cutting position for such subsequent cutting; and (c) a device for applying pressure at predetermined locations against the windings and toward the cutting edges of the blades to cut the strand into such predetermined lengths.

The cutting edges of the apparatus may face radially outwardly to define an outwardly facing periphery of the cutting zone and the strand winding device rotates around the cutter head spaced outwardly from such outwardly facing periphery. However, the cutting edges of the apparatus may also be constructed to face radially inwardly to define an inwardly facing periphery of the cutting zone and the strand rotating device rotates around inside the cutter head spaced inwardly from such inwardly facing periphery. The axis of the strand winding device in each instance intercepts the axis of the cutting head at about the center of the cutting zone width.

The device for applying pressure may comprise two pressure rollers each spaced opposite from the other roller and at a predetermined distance from the cutting edges. Each pressure roller also has a face width that extends over a portion of the cutting zone width essentially different from the other portion over which the face width of the other pressure roller extends and partially overlaps such other portion. The two pressure rollers together have a combined face width sufficient to extend at least across the cutting zone width. If desirable, one of the pressure rollers may have a greater diameter than the other pressure roller.

The invention also provides a method of cutting a strand into predetermined lengths, the method being characterized by the steps of (a) positioning and storing multiple windings of strand in cutting position along a predetermined width of a cutting zone of a predetermined width and a predetermined peripheral length formed by the cutting edges of a plurality of cutting blades mounted and arranged on a cutting head by crossing each winding along a helical path over a previous winding one or more times; and (b) applying pressure at predetermined locations against the windings and toward the cutting edges of the blades to cut the strand into such predetermined lengths. The steps of positioning and storing include rotating the cutting head around its axis at a predetermined speed of rotation and winding the strand into the cutting position at a greater speed than the predetermined speed of rotation of the cutting zone. The step of winding the strand into the cutting position includes traversing the strand back and forth along a predetermined width of the cutting zone per each individual winding.

In such method when the cutting edges face radially outwardly to define an outwardly facing periphery of the cutting zone, the strand is positioned and stored around such outwardly facing periphery. Conversely, when the cutting edges face radially inwardly to define an inwardly facing periphery of the cutting zone, the strand is positioned and stored inside such inwardly facing periphery.

BRIEF DESCRIPTION OF DRAWINGS

The details of the invention will be described in connection with the accompanying drawings, in which.

DETAILED DESCRIPTION OF THE INVENTION

Figure 1:
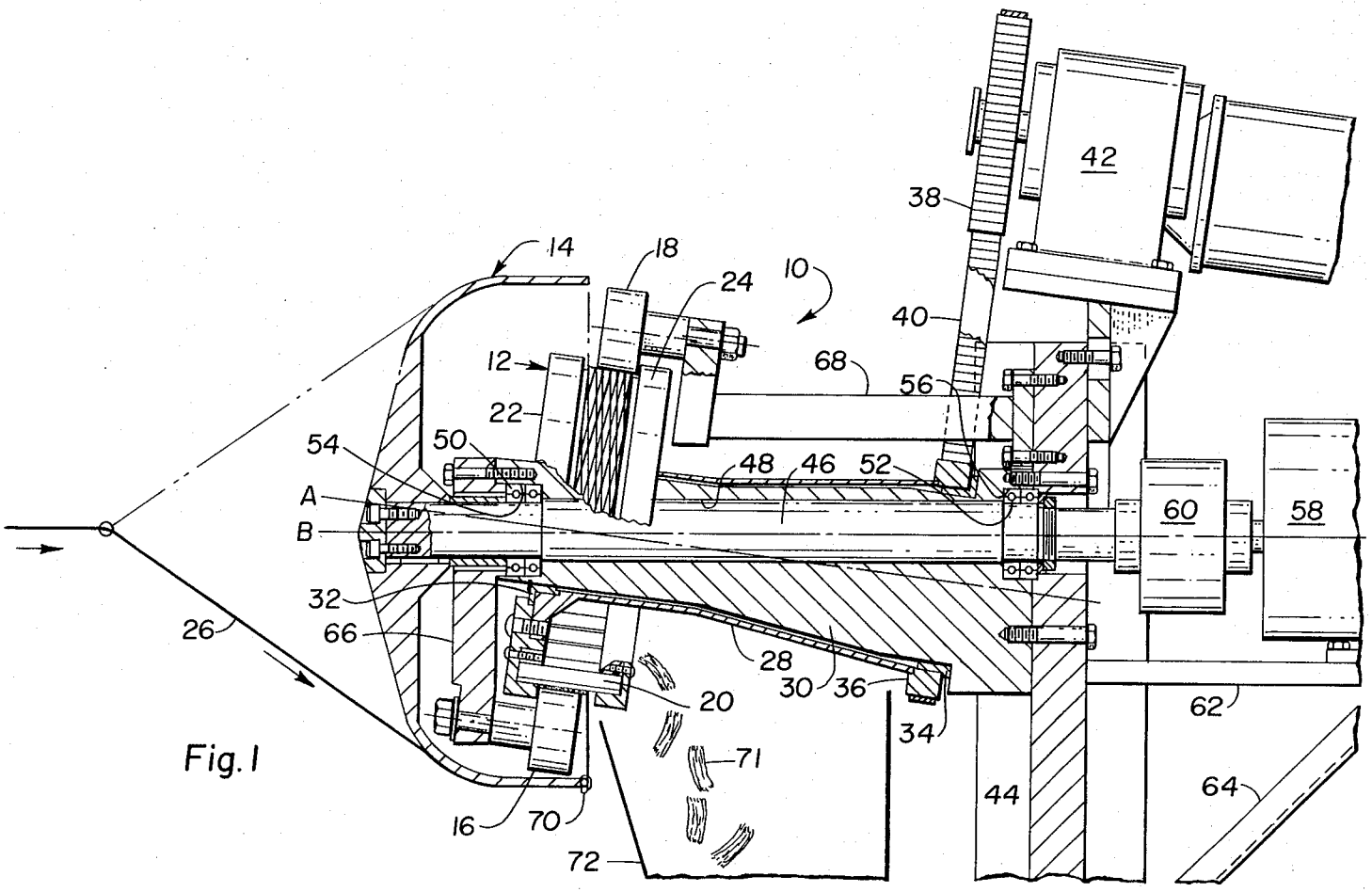
FIG. 1 is an elevational view partly in cross-section and partly broken away of the staple fiber cutter of the present invention.
Figure 2:
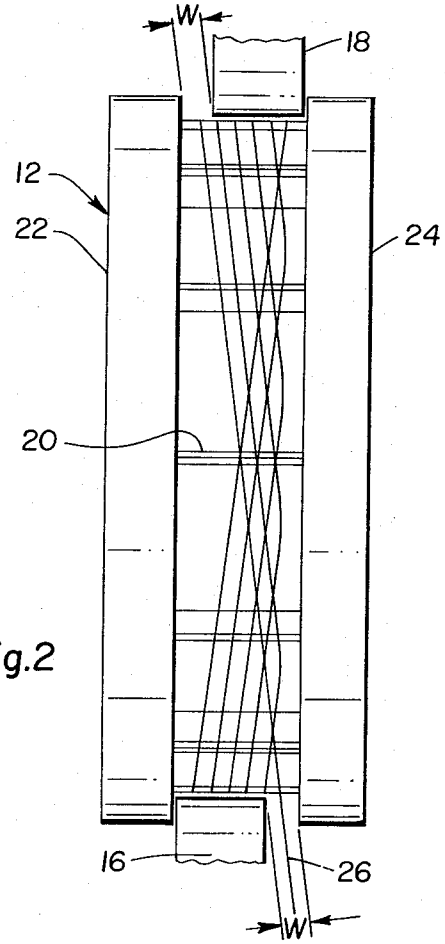
FIG. 2 is an enlarged view of the cutting head of the staple fiber cutter and the pressure rollers with the pressure rollers only being shown in part and illustrating the "window" through which the strand enters the cutting zone.

In reference to FIGS. 1 and 2 of the drawings, 10 designates the staple fiber cutter of the present invention. The cutter has a cutting head 12, which is mounted for rotation around its axis A; a strand winding device 14, which is mounted for rotation around its axis B; and two pressure rollers 16,18, each spaced opposite the other and from the cutting head 12. The two axes A and B intercept each other in a manner to be described.

The cutting head 12 has a plurality of cutting blades 20 mounted between a disc 22 and an annular ring 24. The cutting blades are arranged around the cutting head at spaced intervals to form a cutting zone of predetermined width and predetermined peripheral length. The cutting zone receives and stores in cutting position multiple windings of strand 26 for subsequent cutting into predetermined lengths in a manner to be described. The cutting edges of the cutting blades face radially outwardly to define an outwardly facing periphery of the cutting zone.

The cutting head 12 is connected to the outer axial end of a rotatable support shaft 28, which is supported for rotation around a fixed supporting column 30 by sleeve bearings 32,34. The cutting head may rotate in the same direction as the strand winding device, or in the opposite direction. The rotatable support shaft and connected cutting head are rotated by the gear belt pulleys 36,38, gear belt 40 and motor 42. The fixed supporting column is suitably connected to a main support 44, and motor 42 is supported at one end of the main support. The main support may be connected to a floor (not shown).

The strand winding device 14 is suitably connected to the outer axial end of rotatable shaft 46, which is positioned for rotation within a cylindrical bore 48 extending through the fixed supporting column 30. Roller bearings 50,52 which are seated, respectively, within counterbores 54,56 that are formed, respectively, at opposite ends of the fixed supporting column, support the rotatable shaft 46 for rotation. A separate motor 58 drives the rotatable shaft 46 in rotation through a flexible coupling 60. The motor 58 is supported by brackets 62,64 which are connected to the main support 44.

The strand winding device 14 is preferably in the form of a lightweight, thin shell or dome-like member which can be rotated at high speeds but at minimum noise levels. The outer surface of the shell or dome-like member serves to guide the oncoming strand to the cutting head with minimal amount of friction. The strand winding device may also be in the form of a hollow tube (not shown in FIG. 1), but it has been found that as the tube is rotated at this speed the noise level is increased due to the resulting high pitched whistle caused by the tube whipping around through the air.

Pressure roller 16 is mounted for free rotation in place and is eccentrically supported for adjustment toward and away from the cutter blades on support arm 66, which is suitably secured to the outer axial end of the fixed supporting column 30. Pressure roller 18 is also mounted for free rotation in place, and is eccentrically supported for adjustment toward and away from the cutter blades on support arm 68, which is suitably secured to the main support 44.

Each pressure roller has a face width that extends over a portion of the cutting zone width that is essentially different from the other portion over which the face width of the other pressure roller extends, and partially overlaps such other portion. The purpose of such "overlap" is to ensure that the stored windings are completely cut across the width of the cutting zone. The combined face widths of the two pressure rollers, therefore, must be sufficient to extend at least across the cutting zone width.

In operation, the "strand" 26, which may comprise one or more spinning cabinet ends or one or more yarn package ends, is guided over the surface of the strand winding device 14, through a U-shaped guide 70 secured to the edge of the shell or dome-like member, so as to make the turn around the edge of the shell or dome-like member and then toward the cutting head 12 to be received and stored in cutting position in the cutting zone formed by the cutting blades between the disc 22 and annular ring 24. The U-shaped guide 70 should be made of some suitable material to resist wear and to minimize friction on the strand.

As previously mentioned, cutting head 12 rotates around its axis A and the strand winding device 14 rotates around its axis B, with the two axes intercepting each other. The location of such interception is at about the center of the cutting zone width, the cutting zone being, as also mentioned previously, of predetermined width and predetermined peripheral length. The "predetermined peripheral length" is formed, of course, by the cutting blades as they are spaced around the cutting head, whatever circumference is used. The "predetermined width" is formed by the exposed lengths of the cutting blades between the disc 22 and annular ring 24. Thus the center of the "predetermined width" where the two axes intercept will be at about the center of the cutting head midway of the exposed cutting blade length.

The strand 26 approaches the cutting zone through a "window" W (FIG. 2), which is a space that extends around the cutting head between the disc 22 and pressure roller at one side of the cutting head and the annular ring 24 and pressure roller 16 at the other side of the cutting head, so as to avoid interference with the pressure rollers as both of the cutting head and strand winding device make their respective, relative rotations. This "window" may be seen more clearly by reference to FIG. 2. Each winding, as positioned in the cutting position, crosses the cutting blades at a predetermined angle and also crosses any previous winding one or more times. As the strand winding device rotates around its axis B around the cutting head at a higher rate of speed, the cutting head also rotates around its axis A but at a slower rate of speed, with the consequence that each winding is positioned around the cutting blades 10 side by side with a previous winding and with the further result that the strand winding device in effect traverses back and forth along a "predetermined width" of the cutting zone. Such "predetermined width" could be the same as or less than the width of the cutting zone, depending upon the angle the strand makes to clear not only the two pressure rollers but also to avoid contacting the discs supporting the cutting blades. The windings are thus received and stored in cutting position until such time as the windings build up layers sufficiently thick enough to fill the space between the cutting edges of the cutting blades 20 and the pressure rollers 16,18, at which time the pressure rollers apply pressure against the positioned strands and thereby force the innermost layers against and past the cutting edges in a severing action. The windings thus are cut in predetermined lengths or staple fiber lengths 71 and are discharged from the cutting head to the discharge funnel 72 positioned below the cutting head for subsequent conveyance elsewhere.

The manner in which the windings are formed in the cutting position is thus similar to the manner in which windings are formed on a cross-wound package, and for this reason this staple fiber cutter may be referred to as being a "package wind cutter". This cross-winding arrangement serves at least three purposes: (1) It enables a large number of windings to be taken up in a relatively short time period; (2) it provides a method of distributing the windings in an orderly manner in the cutting zone; and (3) it provides a high degree of stability, as obtained by "locking in" the previous windings until they are ready to be cut. As heretofore described, the strand winding device may revolve around the cutting head two hundred times while the cutting head in the same length of time only makes one revolution.

By way of example, the angle between two axes A and B may be about 7° and the helix angle that the windings make with respect to the cutting blades may be about 4.85° . The purpose for the interception of the two axes occurring at about the center of the cutting zone width is so that the windings will be distributed evenly across the selected predetermined width of the cutting zone width.

The amount of strand windings received and stored preparatory to cutting will be dependent upon the amount of space between the cutting edges of the cutting blades 20 and the pressure rollers 16,18. The pressure rollers, as heretofore indicated, may be adjusted to and from the cutting blades. An example of preferred spacing may be about ¼inch (about 6.3 millimeters).

Figure 3:
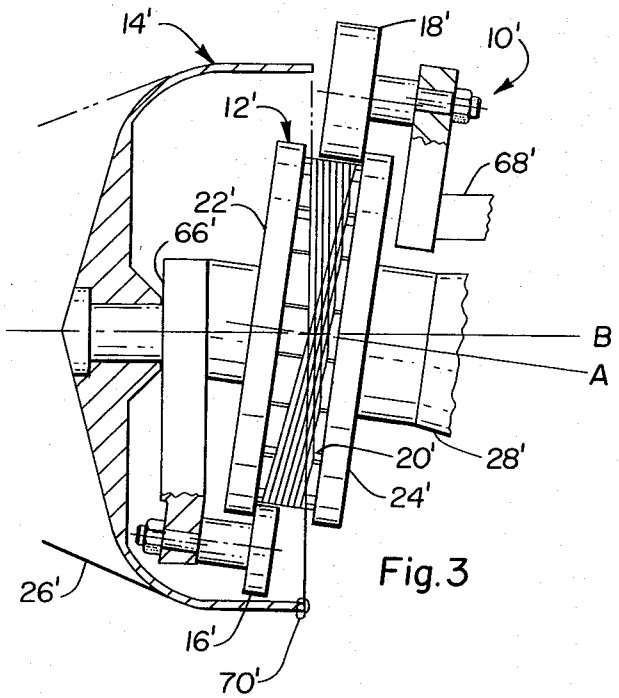
FIG. 3 is a fractional elevational view in cross-section of an alternate embodiment illustrating one of the pressure rollers as being greater in diameter and width than the other pressure roller.

FIG. 3 discloses an alternate embodiment of FIG. 1; therefore, like parts which are also shown in FIG. 1, are identified with the same reference numbers with each number followed by a prime mark. FIG. 3 shows that pressure roller 18' may have a larger diameter and larger width than that of pressure roller 16'. The greater diameter allows pressure roller 18' to more readily bridge the gap between adjacent cutting blades so as to distribute the pressure over a greater area and minimize "bumping" as the pressure roller passes from one cutting blade to the next through the thicknesses of the strands wound around the cutting head. The larger pressure roller thus has greater influence in the cutting action than the smaller pressure roller. The smaller pressure roller, therefore, serves to "clean up" the remainder of the windings in the cutting zone by finishing the cut across the cutting zone. The smaller pressure roller will still "bump" but at a lesser intensity; consequently, it provides a lesser amount of vibration. The vibration effect is minimized in the first instance, however, due to the fact that the cutting head rotates at a relatively slow rate.

Figure 4:
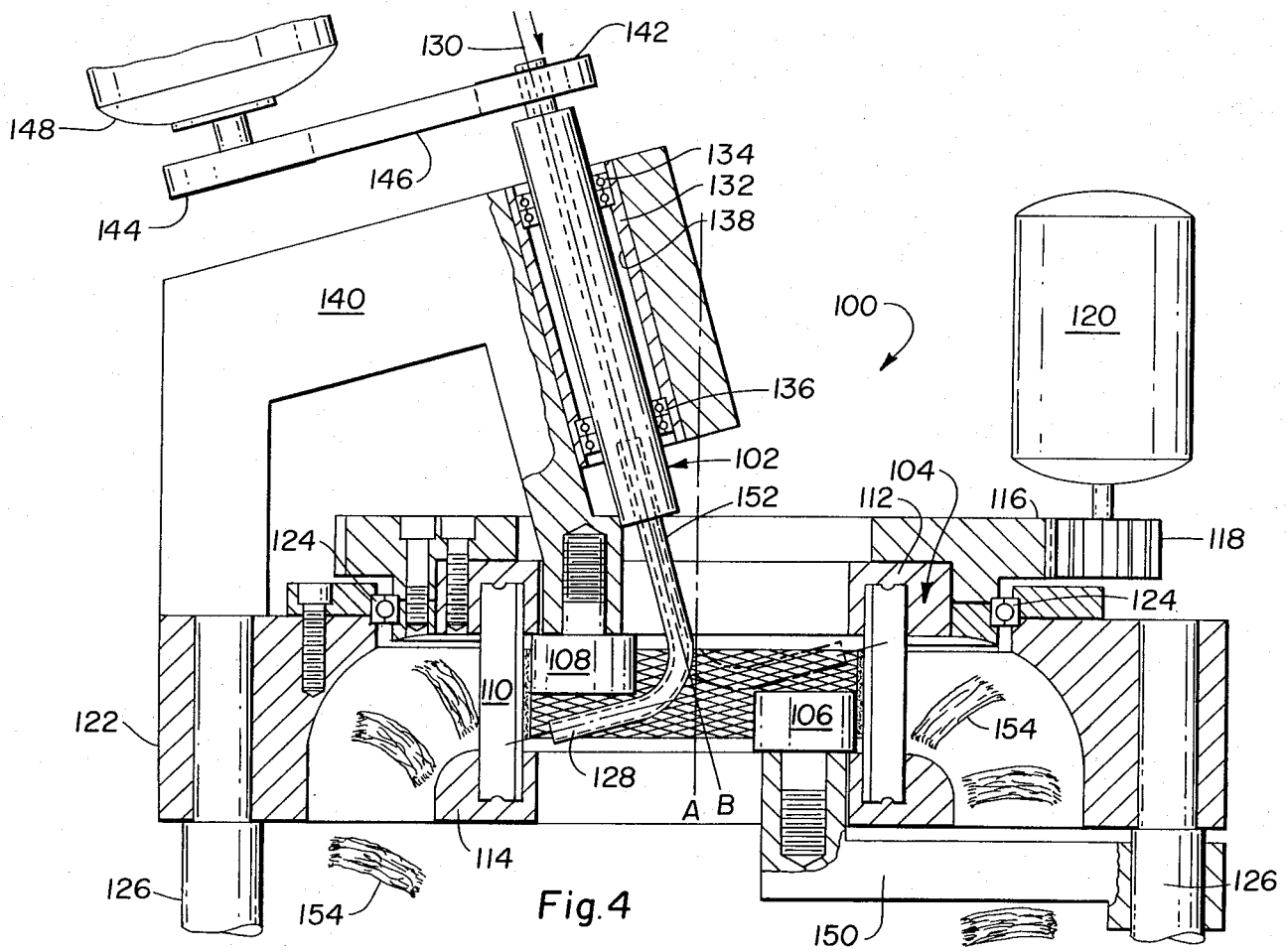
FIG. 4 is an elevational view, partly in cross-section illustrating a strand winding device positioned for rotation within the cutting head.

FIG. 4 represents an alternate embodiment of a staple fiber cutter 100, which comes within the scope of the present invention and wherein a strand winding device 102 revolves within cutting head 104 to position windings of strand in cutting position. Pressure rollers 106 and 108 are also positioned opposite each other within the cutting head 104, and the cutting blades 110 have their cutting edges facing radially inwardly.

Cutting head 104 is mounted for rotation around its axis A, and the strand winding device 102 is mounted for rotation around its axis B. The two axes intercept each other at about the center of the cutting zone width, as described with respect to the embodiment shown in FIGS. 1 and 2.

The cutting head 104 includes annular discs 112, 114 for supporting therebetween the cutting blades 110, and the cutting head in turn is suitably secured to a ring or bull gear 116 to be driven in rotation thereby. The ring or bull gear 116 is engaged by gear 118, which is driven in rotation by motor 120. Gear 116 is supported for rotation on a main frame support 122 by bearings 124. The main frame support may be mounted on support columns 126.

The strand winding device 102 may be in the form of a shell or dome-like member such as is shown in FIG. 1 or in the form of a hollow tube 128, as shown in FIG. 4 and through which the strand 130 travels for delivery to the cutting position in the cutting zone formed by the cutting blades within the cutting head. The hollow tube is driven in rotation at a significantly higher rate of speed than the cutting head 104 so that the strand 130 is propelled into cutting position to form side-by-side windings in the manner disclosed in FIG. 1. The hollow tube 128 is supported for rotation within a housing 132 by bearings 134,136, with the housing 132 having a bore 138 therethrough to secure the hollow tube and being secured to support member 140. Support member 140 is in turn suitably secured to the main frame support 122. The hollow tube may be driven in rotation by gear pulleys 142, 144, gear belt 146 and motor 148.

The pressure rollers 106,108 each may be mounted eccentrically for adjustment toward and away from the cutting blades.

Pressure roller 106 is mounted on support arm 150, which is connected to one of the support columns 126; and pressure roller 108 is mounted on support arm 152 which is connected to support member 140.

OPERATION

Operation of the staple fiber cutter disclosed in FIG. 4 is nearly the same as for the embodiment shown in FIG. 1 except for the fact that the strand in FIG. 4 is positioned in multiple windings within the inner periphery of the cutting head instead of around the outer periphery thereof. Centrifugal forces are thus relied upon to maintain the multiple windings in position for cutting. One advantage of such arrangement is to enable the cut staple fiber 154 to be discharged radially outwardly from the cutting head, as illustrated in FIG. 4.

For instance, a 20,000 denier strand may be fed to the hollow tube 128 as it rotates at 4,000 rpm. The resulting propelling forces from the strand winding device would be about 100 grams, which should be more than sufficient to overcome frictional losses as the strand passes through the hollow tube. This corresponds to strand speeds of about 2,000 meters per minute. This is considering also that the inside circumference of the cutting head would be at least about 0.5 meter. Equations which cover centrifugal effects on rotating bodies are well known in the art.

It should be understood that the separate drive motors shown herein for the cutting head and strand winding device may be variable speed drives; they may be synchronized so that as the strand winding device is speeded up or slowed down the cutting head will be proportionately increased or decreased in speed; and that it would be possible to have a single drive which would operate through a series of gears to provide the differential speeds required by both the strand winding device and cutting head.

The invention has been described in detail with particular reference to preferred embodiments thereof, but it will be understood that variations and modifications can be effected within the spirit and scope of the invention.

I claim:

1. Apparatus for cutting a strand into predetermined lengths, said apparatus characterized by:

(a) a cutting head mounted for rotation around its axis at a predetermined speed, said cutting head having a plurality of cutting blades mounted and arranged to form a cutting zone of predetermined width and predetermined peripheral length to receive and store in cutting position multiple windings of strand for subsequent cutting into said predetermined lengths;

(b) strand winding means mounted to rotate around an axis intercepting said axis of the cutting head in such manner that said strand winding means traverses back and forth along a predetermined width of said cutting zone during each revolution of the strand winding means, said strand winding means rotating at a significantly faster speed than said cutting head and the relative rotations of said strand winding means and said cutting head cooperating to position multiple crossing windings of said strand in said cutting position for said subsequent cutting; and (c) means for applying pressure at predetermined locations against said windings and toward the cutting edges of said blades to cut said strand into said predetermined lengths.

2. Apparatus as defined in claim 1 wherein said cutting edges face radially outwardly to define an outwardly facing periphery of said cutting zone and said strand winding means rotates around the cutter head spaced outwardly from said outwardly facing periphery.

3. Apparatus as defined in claim 1 wherein said cutting edges face radially inwardly to define an inwardly facing periphery of said cutting zone and said strand winding means rotates around inside the cutter head spaced inwardly from said inwardly facing periphery.

4. Apparatus as defined in claim 1 wherein the axis of said strand winding means intercepts the axis of the cutting head at about the center of said cutting zone width.

5. Apparatus as defined in claim 1 wherein said means for applying pressure comprises two pressure rollers each spaced opposite from the other roller and at a predetermined distance from said cutting edges, each pressure roller also having a face width that extends over a portion of the cutting zone width essentially different from the other portion over which the face width of the other pressure roller extends and partially overlaps said other portion, said two pressure rollers together having a combined face width sufficient to extend at least across the cutting zone width.

6. Apparatus as defined in claim 5 wherein one of the pressure rollers has a greater diameter than the other pressure roller.

7. Method of cutting a strand into predetermined lengths, said method characterized by the steps of (a) positioning and storing multiple windings of strand in cutting position along a predetermined width of a cutting zone of a predetermined width and a predetermined peripheral length formed by the cutting edges of a plurality of cutting blades mounted and arranged on a cutting head by crossing each winding along a helical path over a previous winding one or more times; and (b) applying pressure at predetermined locations against said windings and toward the cutting edges of said blades to cut said strand into said predetermined lengths.

8. Method of cutting as defined in claim 7 wherein said steps of positioning and storing include rotating the cutting head around its axis at a predetermined speed of rotation and winding the strand into said cutting position at a greater speed than said predetermined speed of rotation of the cutting head.

9. Method of cutting as defined in claim 8 wherein the step of winding the strand into said cutting position includes traversing the strand back and forth along a predetermined width of said cutting zone per each individual winding.

10. Method of cutting as defined in claim 7 wherein said cutting edges face radially outwardly to define an outwardly facing periphery of said cutting zone and said strand is positioned and stored around said outwardly facing periphery.

11. Method of cutting as defined in claim 7 wherein said cutting edges face radially inwardly to define an inwardly facing periphery of said cutting zone and said strand is positioned and stored inside said inwardly facing periphery.

* * * * *